United States Patent [19]

Soum

[11] 3,952,468

[45] Apr. 27, 1976

[54] ASSEMBLY OF PREFABRICATED PRESTRESSED CONCRETE ELEMENTS WITH THE USE OF A POSTSTRESSING LINK MEANS

[76] Inventor: René Soum, 2, rue Joliment, 31 Toulouse, France

[22] Filed: May 1, 1974

[21] Appl. No.: 465,948

Related U.S. Application Data

[63] Continuation of Ser. No. 310,163, Nov. 28, 1972, abandoned.

[30] Foreign Application Priority Data

Jan. 4, 1972 France ..... 72.00691

[52] U.S. Cl. ..... 52/227; 52/223 R; 52/583; 52/587

[51] Int. Cl.[2] ..... E04C 2/06; E04C 5/12; E04C 3/26

[58] Field of Search ..... 52/223 R, 223 L, 225, 52/227, 583, 587, 231; 264/228; 403/43, 44, 306, 307, 337; 29/452

[56] References Cited

UNITED STATES PATENTS

| | | | |
|---|---|---|---|
| 161,832 | 4/1875 | Spencer | 403/43 |
| 2,344,223 | 3/1944 | Upson et al. | 52/227 X |
| 2,611,262 | 9/1952 | Dodson et al. | 52/583 X |
| 3,060,639 | 10/1962 | Fields | 29/452 |
| 3,089,215 | 5/1963 | Stubbs | 52/223 R X |
| 3,387,417 | 6/1968 | Howlett | 52/223 L |
| 3,394,522 | 7/1968 | Maurer | 52/227 X |
| 3,405,490 | 10/1968 | LaMarr | 52/223 R |
| 3,427,772 | 2/1969 | Williams | 52/223 R |
| 3,498,013 | 3/1970 | Kern | 52/225 |
| 3,621,626 | 11/1971 | Tylius | 52/227 |
| 3,736,709 | 6/1973 | Koch | 52/227 X |

FOREIGN PATENTS OR APPLICATIONS

| | | | |
|---|---|---|---|
| 31,839 | 6/1927 | France | 52/223 R |
| 1,068,388 | 6/1954 | France | 29/452 |
| 122,458 | 1/1919 | United Kingdom | 403/43 |
| 10,844 | 10/1902 | Austria | 403/43 |
| 656,386 | 10/1963 | Italy | 403/43 |
| 216,037 | 7/1961 | Austria | 52/223 R |
| 1,526,738 | 4/1968 | France | 52/223 L |
| 649,250 | 11/1962 | Italy | 52/227 |
| 709,150 | 5/1965 | United Kingdom | 52/225 |
| 104,229 | 2/1963 | Netherlands | 52/223 L |
| 155,756 | 3/1954 | Australia | 52/223 R |

*Primary Examiner*—Ernest R. Purser
*Assistant Examiner*—Leslie A. Braun
*Attorney, Agent, or Firm*—William A. Drucker

[57] ABSTRACT

Assembly of prefabricated pre-stressed reinforced concrete elements solid with their reinforcements comprising linking means including at least one internally threaded cage, nuts in said cage, mounted on externally threaded parts directly or indirectly rigidly coupled to the reinforcements; the nuts abut against the cages by means of ball-and-socket bearings, thus making allowance for any misalignments of the elements. The reinforcements being solid with the concrete, this linking means affords for supplemental adjustment stress in particular elements only, whereby the assembly may be rendered statically indeterminate.

8 Claims, 4 Drawing Figures

ASSEMBLY OF PREFABRICATED PRESTRESSED CONCRETE ELEMENTS WITH THE USE OF A POSTSTRESSING LINK MEANS

This is a continuation of application Ser. No. 310,163, filed Nov. 28, 1972, now abandoned.

BACKGROUND OF THE INVENTION

1. Field of the Invention

The present invention relates to the assembly of statically indeterminate prefabricated pre-stressed reinforced concrete elements.

2. Description of the Prior Art

Australian Patent No. 155,756 granted to Stressteel for "Reinforced concrete constructions utilizing jointed reinforcement under tension" shows an apparatus for prestressing reinforcements or for adding important stresses to pre-stressed reinforcements. The stresses are applied uniformly to all the reinforcements which are prevented from bonding to the concrete by means of tar or like. The stressing device comprises an auxiliary hydraulic assembly and a cage fixed to the reinforcements by means of nuts, outside the cage; split washers, preventing the nuts from crushing the concrete are removed after the stressing has been carried out.

U.S. Pat. No. 3,405,490 granted to Robert R. La Marr for "Anchor structure for post-tensioned tendons" describes a button-head type tensioning assembly for reinforcements in concrete elements. Button-heads-formed on the opposite ends of the reinforcements are received in soft bushings placed in sockets located in slots formed in dead-end plates disposed at opposite portions of the concrete member. Upon applying tension to the tendons, by means of a nut-and-collar type apparatus, the heads are compressed into the bores of the bushings, thereby expanding the bushing and locking it in the associated socket. Here again, the reinforcements are prevented from bonding to the concrete. U.S. Pat. No. 3,387,417 granted to Howlett for "Prestressing Apparatus" describes an apparatus for coupling reinforced concrete elements while stressing the reinforcements. An externally threaded tubular sleeve is concentrically mounted on the spliced reinforcements which terminate with a button head and is secured to plate embedded in concrete. A coupling cage having an internally threaded bore engages with the sleeve member. Several sleeves may engage with one cage, thus allowing coupling of concrete elements having reinforcements of different diameters and of concrete elements having different numbers of reinforcements. External jacking means are applied for tensioning the reinforcements.

It is also common practice to weld together the iron rods projecting from the elements and to complete the joints by cementing them. Such a procedure, however, is slow and cumbersome, and does not allow for any standardization of the ends of the elements to be assembled.

A device has also been proposed to ensure the transmission of tensile stresses between reinforcements by means of conical anchorages. This system, however, has the disadvantage that the cones gradually sink in, causing a loss of tension, and that they do not permit adjustment of the traction between the reinforcements. Another suggestion was for systems which enabled the reinforcements to be joined without allowing the reinforcement to be subjected to stresses before the prefabricated elements were placed in position or the stresses at right angles to the joints to be adjusted. Finally, assembly devices have been proposed in my U.S. Pat. No. 3,665,665 granted May 30, 1972 for "Assembly of Concrete Support Elements", using the same part according to whether the joint is girder to girder, girder on upright or girder with girder on upright, the fitting operation consisting merely of tightening bolts. But the elements to be assembled had a joint plane bisecting the angle between the longitudinal axes of the elements. This method resulted in a marked simplification and standardization of the assembly operations, but its applications remain limited.

Summary

It is proposed in this invention to provide linking means for pre-stressed re-inforced concrete elements, which linking means comprise $n$ internally threaded cages, where $n$ is an integer smaller than 3, and two nuts therein, coupled to the re-inforcements in said elements, by means of $(n + 1)$ externally threaded parts, cages and nuts abutting against each other by means of ball-and-socket bearings, thus making allowance for mis-alignments, if any.

More, the elements being essentially pre-stressed, the reinforcements are solid therewith, and any additional tensioning effected by means of the cage and nut assembly is entirely supported by the elements coupled to this assembly. Thus the system has become statically indeterminate, which was not possible with the known systems where either any adjustment is distributed along the entire assembly of elements, when the reinforcements are not solid with the concrete, or no adjustment is possible.

Finally, all the elements of the linking means according to the invention may be standardized and simply prefabricated, and simple also are the assembly operations.

The invention is applicable to the manufacture of all types of portable structures.

DESCRIPTION OF PREFERRED EMBODIMENTS

Figure 1:
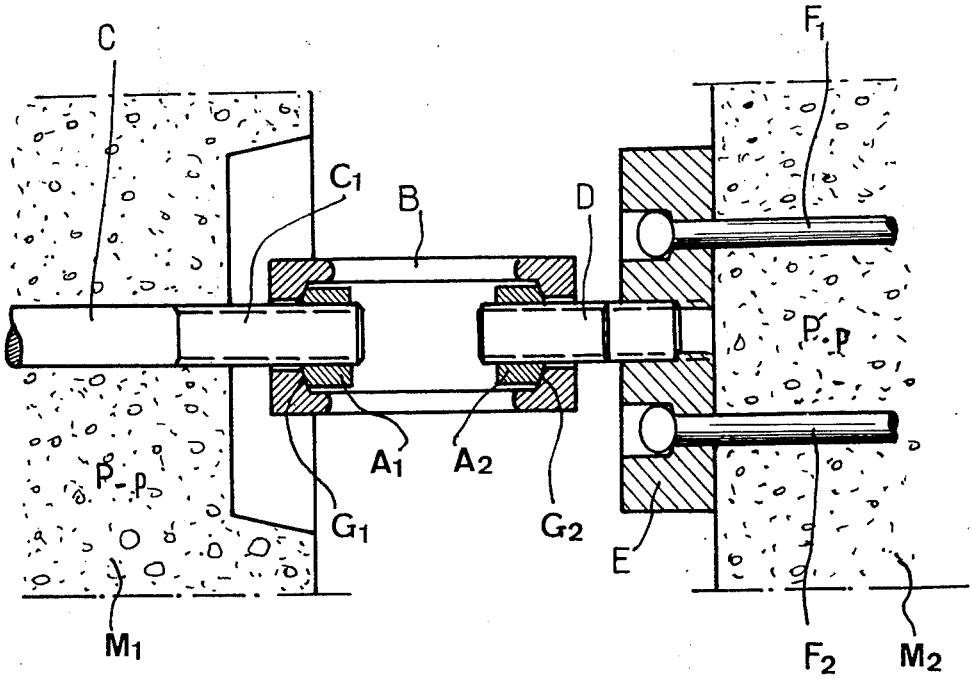
FIG. 1 shows in section a first method of accomplishing the invention.

FIG. 1 shows two prefabricated prestressed reinforced concrete elements $M_1$ and $M_2$. Re-inforcement C, in element $M_1$ has a threaded extremity $C_1$. Re-inforcements $F_1$ and $F_2$ in element $M_2$ are button-head terminated in sockets formed in an anchoring plate E solid with element $M_2$. Re-inforcements C, and $F_1$, $F_2$, are respectively bonded along their surface with element $M_1$ and $M_2$. Element $M_1$ is cut-out at its extremity facing element $M_2$.

Figure 2:
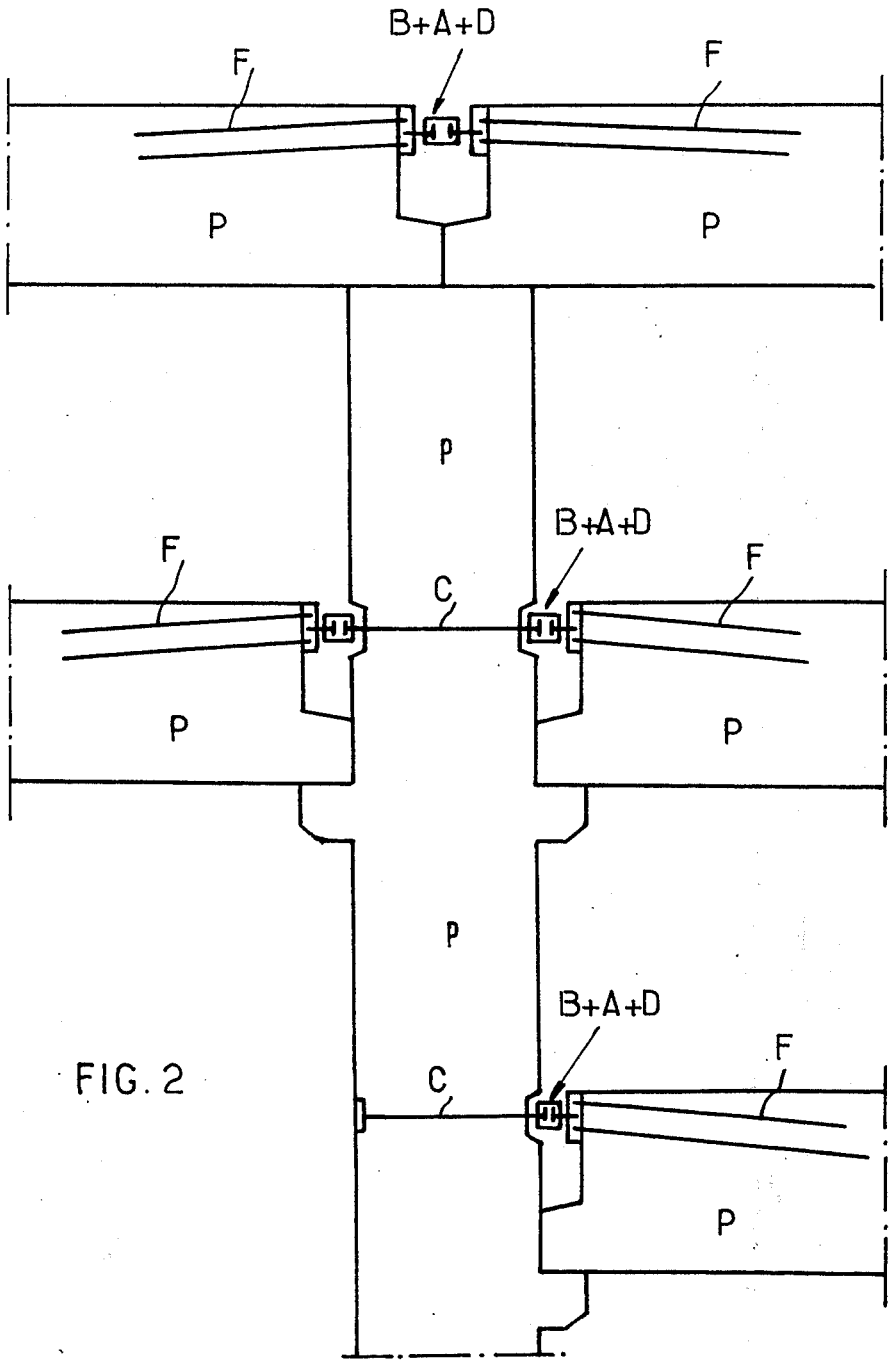
FIG. 2 shows various types of assembly based on this first method.

The linking means, locking with each other the prefabricated elements comprise two nuts $A_1$ and $A_2$ bearing on the inner extremities of an indented cage B which allows the device to be fitted after the prefabricated elements have been placed in position. Nuts $A_1$ and $A_2$ abut against cage B by means of ball-and-socket bearings $G_1$ and $G_2$. Nut $G_1$ is screwed on the threaded extremity of re-inforcement C and nut $G_2$ is screwed on to a threaded rod D secured on to the anchoring plate E of the reinforcements F. By turning B, and with it the two nuts A, a tensile stress is set up between C and D, and consequently between C and $F_1$, $F_2$, locking the prefabricated elements. The device is applicable to the linking of girders P and uprights p, whatever their respective locations, as is shown in FIG. 2 in the upper part of which can be seen the joining of two girders on an upright, while the middle section shows the assembly of two girders on to both sides of an upright and supported on two flanges and the lower section the joining of a girder and an upright. The lettering in this FIG. 2 corresponds to the detailed descriptions in FIG. 1, F representing $F_1$ and $F_2$.

The ball-and-socket bearings make allowance for any misalignment of the elements. The concrete being bonded to the reinforcements along the surface of the latter, the additional tensioning stress applied by screwing the nuts will be distributed among the two elements and entirely absorbed by the latter and their reinforcements, and not transmitted to any further element of the building assembly (not shown) of which elements $M_1$ and $M_2$ (FIG. 1) or, P, *p*, (FIG. 2) are a part. In this manner, i.e. applying, to particular elements of a statically determinate building assembly, additional local stresses, the whole structure becomes statically indeterminate, which property exhibits well-known advantages. Also this locking method makes possible the achievement of resistance of the assemblies to positive and negative moments.

Figure 3:
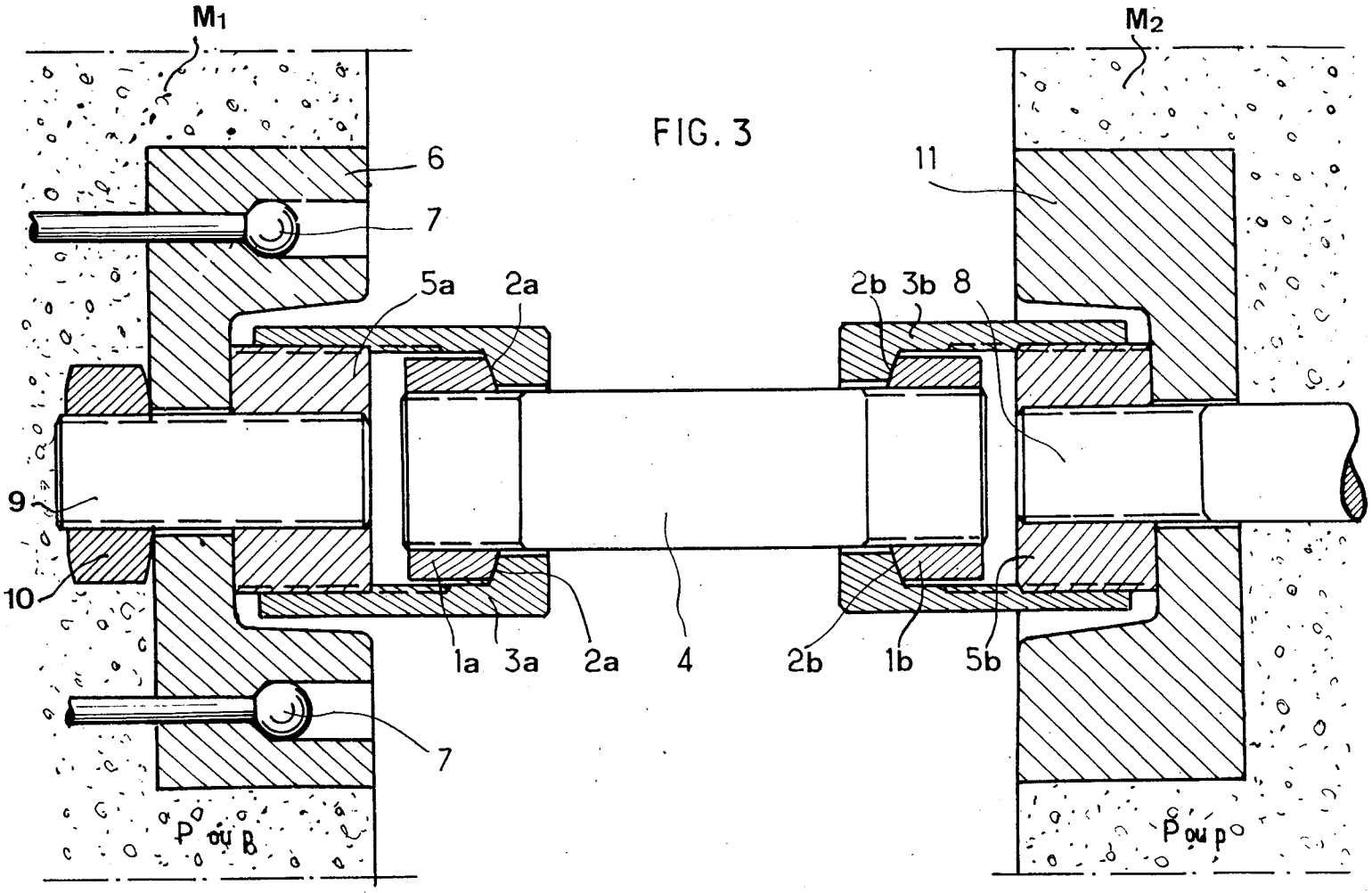
FIG. 3 shows in section a second method of accomplishing the invention.

FIG. 3 shows two nuts 1*a*, 1*b*, with ball and socket bearing 2*a*, 2*b* on cages 3*a*, 3*b*, which, if retracted on the threaded rod 4 allow the insertion of the device after the prefabricated elements have been placed in position. The cages 3*a*, 3*b*, are bolted to threaded nuts 5*a*, 5*b*, forming one part either with the bracing plate 6 of the extremity of the stretched reinforcements 7 by means of a bolt 9 and a nut 10 embedded in the concrete, or of the reinforcement 8. The first case is shown on the left of FIG. 3 and the second case on the right, where it is seen that the locking of the nut 5*a* on the distributing plate 11 causes the previous stressing of the reinforcement 8.

Figure 4:
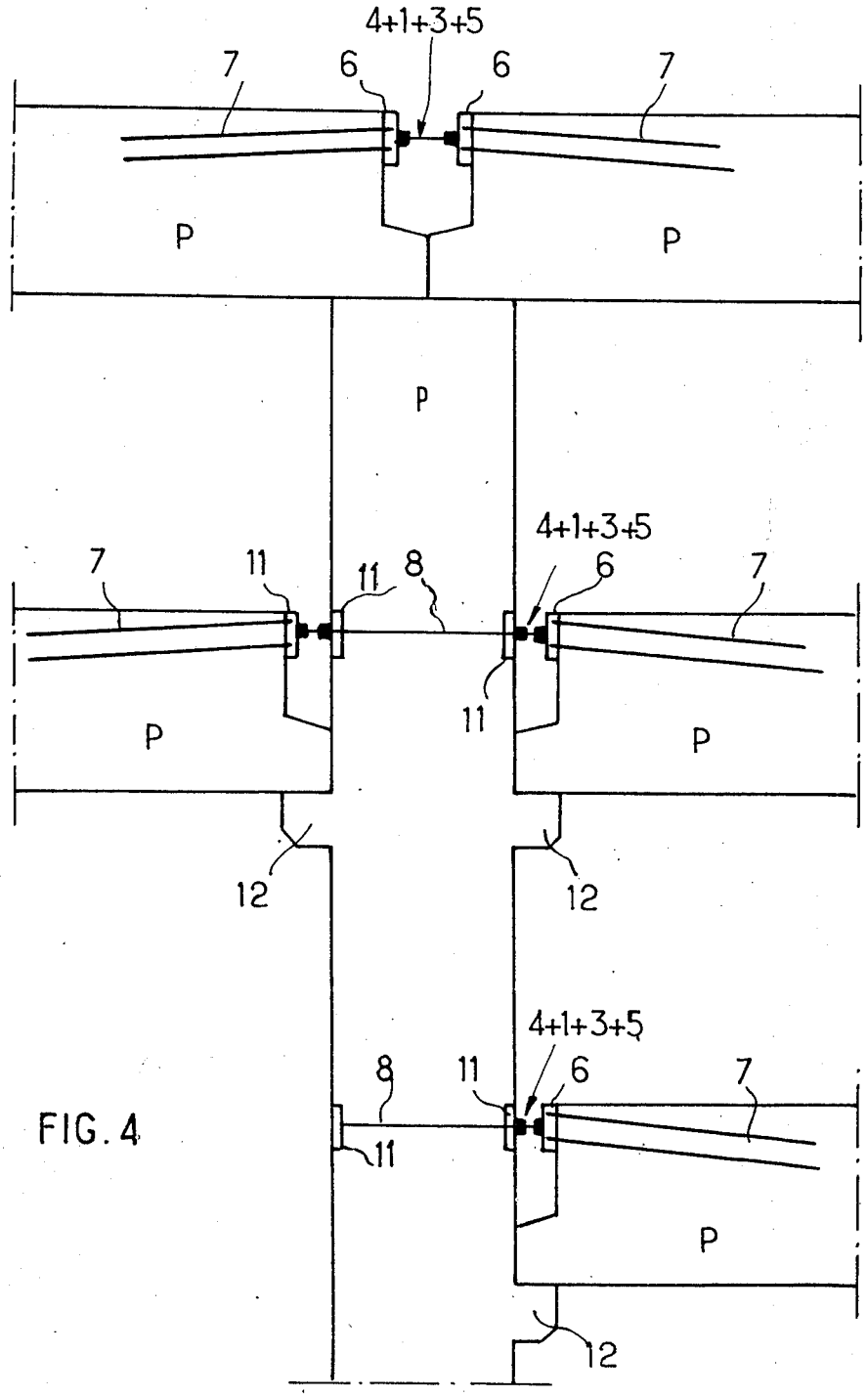
FIG. 4 shows various types of assembly based on this second method.

The locking of the cages 3*a*, 3*b*, causes the gradual stressing of the rod 4, and the rods 8 and 9 and therefore creates a tensile stress between the plates 6 and 11, this tensile stress being regulated independently of the preliminary stresses in the prestressing reinforcements 8 and 9. FIG. 4 shows how the device according to the invention is applicable to the assembly of girders P and posts *p*, or to the assembly of orthogonal girders, whatever their respective layout.

It will be seen that in the upper part of FIG. 4 that we have the assembly of two girders P laid on a post *p*. There will be seen in the central part of FIG. 4, two girders P joined on either side of the post *p;* and in the lower part of FIG. 4 a girder P joined orthogonally to the post *p*. The numerical reference correspond to those of FIG. 3. It will be seen in each of these different cases of FIG. 4 that the girders P always bear either on a shoulder 12 or on the top of the post *p* and that there is a free joint at the upper part, between the girder P and the post *p*. The stressing of the rods 4, 8 and 9 by locking the cage creates a force which, taking into account this bearing of P on the shoulder 12, creates a variable moment or couple in the opposite direction to that which tends to open the assembly through the effect of the weight of P and the vertical loads directed downwards and applied to P.

After locking the cages, the variations of load on the girder P bring about the creation of hyperstatic moments at right angles with the assembly joint between P and *p*, and therefore tensile stresses which are transmitted between prefabricated components through the assembly device, the latter thus allowing the creation of a hyperstatic framework.

In FIGS. 1 and 3, elements $M_1$ and $M_2$ are shown with a different numbers of re-inforcements. It is of evidence that the linking means according to the invention may also be used for locking similar elements, and also, elements having more than two reinforcements, the plate E of FIG. 1 or 6 of FIG. 2 then comprising further sockets, as taught for example in the cited prior art.

In any case, the number of nuts of the linking means is two, the number of cages being either $1(n=1)$ or $2(n=2)$, the number of externally threaded parts inserted in the cages being equal to $n+1$.

I claim:

1. An assembly of prefabricated pre-stressed reinforced concrete elements, wherein each element comprises reinforcing members solid with said element and subjected to predetermined amounts of stress applied before the assembling of the elements, said assembly comprising a plurality of linking means rendering said assembly statically indeterminate through applying selectively to any reinforcement of an element supplemental stress independently of said predetermined stress, said linking means being respectively provided between any couple of said concrete elements, and each comprising: a first and a second cages (3*a*, 3*b*, FIG. 3), each cage having opposite opened-ends, a first externally threaded rod made integral with one of said elements of said couple and threaded into said first cage, a second externally threaded rod made integral with the other one of said elements of said couple and threaded into said second cage, a third rod having a first and a second externally threaded extremities respectively inserted in opened ends of said first and second cages, and a first and second nuts screwed respectively in said cages onto said first and second extremities and abutting respectively against said cages by means of ball-and-socket bearings.

2. Linking means according to claim 1, supplying supplemental stress in two reinforcements of one of said elements, said linking means further comprising a metal plate (6, FIG. 3) anchored on said two reinforcements, said first threaded rod (5*a*, FIG. 3) being made solid with said plate.

3. Linking means according to claim 2, comprising a bolt (9, FIG. 3) screwed in said plate (6) and a nut (10) tightening said bolt, said plate being made solid with said first threaded rod by means of said bolt and last mentioned nut, and being embedded in the concrete.

4. Linking means according to claim 1, supplying supplemental stress in only one reinforcement of one of said element, wherein one of said threaded rods is further internally threaded and is screwed on said reinforcement.

5. Linking means according to claim 4, further comprising a metal plate (11, FIG. 3) embedded in the concrete of said element and anchored to said reinforcement.

6. An assembly of prefabricated pre-stressed reinforced concrete elements, wherein each element comprises reinforcing members solid with said element and subjected to predetermined amounts of stress applied before the assembling of the elements, said assembly comprising a plurality of linking means rendering said assembly statically indeterminate through applying selectively to any reinforcement of an element supplemental stress independently of said predetermined stress, said linking means being respectively provided between any couple of said concrete elements, and each comprising: a cage (B; FIG. 1) having opposite opened ends, a first and a second externally threaded rods (C, D) inserted respectively in said ends, and respectively made integral with the respective elements of said couple, and two nuts respectively mounted on said rods, in said cages, said nuts abutting against said cages by means of ball-and-socket bearings.

7. Linking means according to claim 6, supplying supplemental stress in two reinforcements of one of said elements, said linking means further comprising a metal plate (E, FIG. 1) anchored on said two reinforcements, said first threaded rod (D, FIG. 1) being made solid with said plate.

8. Linking means according to claim 7, wherein said plate (E, FIG. 1) is directly screwed on said first threaded rod.

* * * * *